US007215284B2

(12) United States Patent
Collinson

(10) Patent No.: US 7,215,284 B2
(45) Date of Patent: May 8, 2007

(54) PASSIVE SELF-SWITCHING DUAL BAND ARRAY ANTENNA

(75) Inventor: Donald L. Collinson, Lafayette, NY (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 11/128,729

(22) Filed: May 13, 2005

(65) Prior Publication Data

US 2006/0256024 A1 Nov. 16, 2006

(51) Int. Cl.
*H01Q 1/38* (2006.01)
*H01Q 13/10* (2006.01)

(52) U.S. Cl. ..... 343/700 MS; 343/770

(58) Field of Classification Search ..... 343/700 MS, 343/767, 770, 860
See application file for complete search history.

(56) References Cited

U.S. PATENT DOCUMENTS 3,845,490 A 10/1974 Manwarren et al.
4,067,016 A 1/1978 Kaloi
4,125,837 A 11/1978 Kaloi
4,356,492 A * 10/1982 Kaloi ..... 343/700 MS
4,500,887 A 2/1985 Nester
4,673,943 A 6/1987 Hannan
4,800,393 A 1/1989 Edward et al.
4,825,220 A 4/1989 Edward et al.
4,853,704 A 8/1989 Diaz et al.
5,227,808 A * 7/1993 Davis ..... 343/915
5,264,860 A 11/1993 Quan
5,519,408 A * 5/1996 Schnetzer ..... 343/767
5,825,332 A 10/1998 Camacho et al.
5,828,345 A 10/1998 Waterman et al.
5,841,405 A * 11/1998 Lee et al. ..... 343/795
6,043,785 A * 3/2000 Marino ..... 343/767
6,285,333 B1 9/2001 Reed et al.
6,683,571 B2 1/2004 Ghosh et al.
6,842,154 B1 1/2005 Apostolos
6,859,182 B2 2/2005 Horii
2002/0021246 A1 2/2002 Martek et al.
2004/0085250 A1 5/2004 Tillery

FOREIGN PATENT DOCUMENTS

GB 2281662 A 3/1995

* cited by examiner

*Primary Examiner*—Tan Ho
(74) *Attorney, Agent, or Firm*—Plevy, Howard & Darcy PC

(57) ABSTRACT

A dual band antenna array comprises a pair of coplanar antenna elements, the first antenna element excitable at a frequency within a first frequency band, the second antenna element excitable at a frequency within a second frequency band. A single transmission feed line in a second plane has an input for receiving a signal, the feed line dividing at a branch point into a first line segment for communicatively coupling the first antenna element with the input at a first feed point, and a second line segment for communicatively coupling the second antenna element with the input at a second feed point. The first and second line segments have lengths adapted for impedance matching at the first and second frequency bands, respectively, relative to the feed line input, to selectively allow energy transmission in one of the first and second line segments while reflecting energy in the other line segment according to the input signal frequency, whereby the activated antenna elements are passively switched based on the input signal frequency.

39 Claims, 3 Drawing Sheets

PASSIVE SELF-SWITCHING DUAL BAND ARRAY ANTENNA

FIELD OF INVENTION

The present invention relates generally to antenna systems and more specifically to a dual band array antenna system.

BACKGROUND

Antennas are useful in a variety of data communications applications, including, for example, line-of-sight (LOS) communications applications, satellite communications (SATCOM), cellular telephony and digital personal communications systems (PCS). Antenna systems are often implemented as phased arrays of individual antennas or subarrays of antennas that are excited to cumulatively produce a transmitted electromagnetic wave that is highly directional, in order to provide a signal gain in a desired direction or to reject unwanted signals from other directions. The radiated energy from each of the individual antenna elements or subarrays is of a different phase, respectively, so that an equiphase beam front or cumulative wave front of electromagnetic energy radiating from all of the antenna elements in the array travels in a selected direction. Phase or timing differences among the antenna activating signals determines the direction in which the cumulative beam from all of the individual antenna elements is transmitted, and the characteristics of the radiation pattern of the array. Analysis of the amplitudes and phases of return beams of electromagnetic energy detected by the individual antennas in the array similarly allows determination of the direction from which a return beam arrives.

In communication systems, radar, direction finding and other broadband multifunction systems having limited aperture space, it is often desirable to efficiently couple a radio frequency transmitter and receiver to an antenna having an array of broadband radiator elements. For many antenna array applications, it is further desirable that the radiating antenna elements have low losses (e.g. low RF loss), operate across a wide frequency band of interest, and be inexpensive to fabricate. Several concepts have been investigated to provide radar or communications coverage over more than one frequency band using a single integrated array antenna.

With dedicated radar bands such S-Band and C-Band; C-Band and X-Band, for example, many of which are separated by nearly an octave or more of bandwidth, the selection of a radiating element becomes problematic due at least in part to difficulty in providing a suitable impedance match and element radiating pattern over both bands and the scan volume. A single element type may be impedance matched over one frequency band or the other band, but cannot adequately cover both bands. Similarly, a single element type may provide an adequate element radiating pattern over one frequency band, but exhibits nulls (i.e. minima) in the element radiating pattern in the other frequency band that represents a "blind" scan angle for the array.

Moreover, variations in dipole construction have not yielded a structure that provides both sufficient bandwidth and physically configurable within an element grid of a conventional radar array. While it is known that certain broadband elements such as notch antennas having flared or tapered notch antenna elements may be useful in forming wideband antenna arrays, dual band antenna array systems often require active switching, multiple apertures, and complex impedance matching that undesirably affect performance and usefulness of the device.

A system and method which overcomes the aforementioned difficulties is highly desired.

SUMMARY OF THE INVENTION

According to an aspect of the present invention, there is provided a plurality of integrated antenna elements configured on a substrate and each associated with a corresponding frequency band, that are passively switched during operation so as to provide a dual band array antenna system.

An array of antenna elements excitable at a lower frequency band are spaced in the E-Plane to provide grating lobe-free radiation at an upper frequency band. Interspersed between these elements are smaller antenna elements configured for excitation at an upper frequency band. The upper frequency band may be separated from the lower frequency band by approximately an octave. A single feed line feeds a reactive power divider that, in turn, feeds a pair of the antenna elements, one for the lower band and one for the upper band. From the power divider, the transmission feed lines are constrained by an open circuit feeding the lower band element, which is spaced an integral number of half wavelengths from the power divider at the upper band to prevent energy from entering that leg of the feed line at the upper band. The open circuit feeding the upper band element is spaced an integral number of half wavelengths from the power divider at the lower band to prevent energy from entering that leg of the feed line at the lower band. At each of the two elements, sufficient transmission is provided between the element and the power divider to accommodate an impedance matching transformer.

A dual band antenna array comprises a pair of coplanar antenna elements, the first antenna element excitable at a frequency within a first frequency band, the second antenna element excitable at a frequency within a second frequency band. A single transmission feed line in a second plane has an input for receiving a signal, the feed line dividing at a branch point into a first line segment for communicatively coupling the first antenna element with the input at a first feed point, and a second line segment for communicatively coupling the second antenna element with the input at a second feed point. The first and second line segments have lengths adapted for impedance matching at the first and second frequency bands, respectively, relative to the feed line input, to selectively allow energy transmission in one of the first and second line segments while reflecting energy in the other line segment according to the input signal frequency, whereby the activated antenna elements are passively switched based on the input signal frequency.

According to another aspect, a dual band antenna system comprises a substrate having a first side and a second side; a conductive layer disposed on the first side and configured to form a linear array of interleaved pairs of first and second antenna elements, the first antenna elements excitable at a first frequency band, the second antenna elements excitable at a second frequency band, each pair having an associated single transmission feed line disposed on the second side of the substrate for carrying an input signal at a frequency causing excitation of one of the element pairs. Each single transmission feed line divides at a branch position into a first line segment and a second line segment, the first line segment electromagnetically coupled to the corresponding first antenna element of the pair at a first feed point, and the second line segment electromagnetically coupled to the corresponding second antenna element of the pair at a second feed point, wherein an end of the first line segment terminates in an open circuit a distance of about one quarter wavelength from the first feed point at the center of the first frequency band, and an end of the second line segment terminates in an open circuit a distance of about one quarter wavelength from the second feed point at the center of the second frequency band, and wherein the terminating ends of the first and second line segments are an integer number of half wavelengths from the branch position at the first and second frequency bands, respectively.

According to another aspect, a method for operating a dual band antenna array comprises: providing a pair of coplanar antenna elements excitable at separate frequency bands; feeding the pair of coplanar antenna elements via a single transmission feed line formed in a second plane and having an input for receiving a signal, the feed line dividing at a branch point into a first line segment extending transversely over a first one of the pair of antenna elements at a first feed point, and a second line segment extending transversely over a second one of the pair of antenna elements at a second feed point; the lengths of the first and second transmission line segments adapted according to the first and second frequency bands relative to the feed line input for matching the impedance of the antenna frequency bands with the transmission line impedance to allow efficient transfer of energy to and from the antenna elements, and, selectively applying a signal frequency within one of the separate frequency bands to selectively allow energy transmission in one of the first and second line segments while reflecting energy in the other line segment, thereby communicatively coupling the transmission line input with the corresponding antenna element via the corresponding feed point, whereby the activated antenna elements are passively switched based on the applied signal frequency.

BRIEF DESCRIPTION OF THE DRAWINGS

Understanding of the present invention will be facilitated by consideration of the following detailed description of the preferred embodiments of the present invention taken in conjunction with the accompanying drawings, in which like numerals refer to like parts, and wherein.

DETAILED DESCRIPTION

It is to be understood that the figures and descriptions of the present invention have been simplified to illustrate elements that are relevant for a clear understanding, while eliminating, for the purpose of clarity, many other elements found in radar or communications systems and methods of making and using the same. Those of ordinary skill in the art may recognize that other elements and/or steps may be desirable in implementing the present invention. However, because such elements and steps are well known in the art, and because they do not facilitate a better understanding of the present invention, a discussion of such elements and steps is not provided herein. Moreover, it is to be recognized that the passive radiating antenna elements and their feed structure are reciprocal devices, behaving analogously in a receiving mode as in a transmitting mode. Thus, while the behavior of the elements and their feed structure may be described herein in the receive mode, it should be recognized that these aspects (aside from power-handling characteristics) also apply to the transmit mode.

Figure 1:
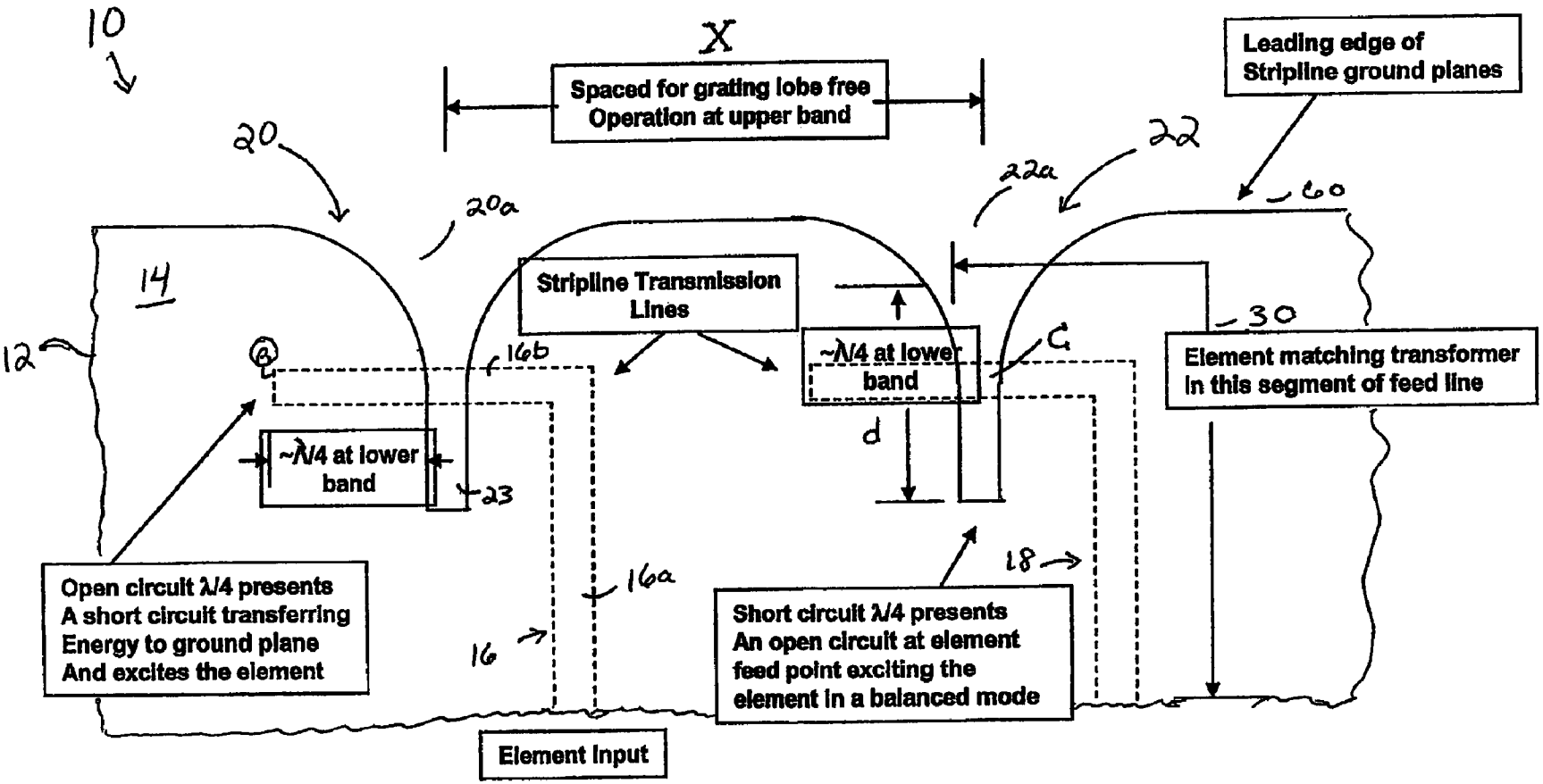
FIG. 1 (PRIOR ART)
FIG. 1 is an exemplary illustration of prior art linear array of stripline notch antenna on a coplanar substrate.

Referring now to FIG. 1, there is shown a conventional (prior art) notch antenna array 10 comprising a substrate formed from a sheet of dielectric material 12 sandwiched between a conducting material 14 and a pair of feed strip transmission lines 16, 18. FIG. 1 illustrates a top view showing the antenna face of the dielectric 12. A plurality of tapered notch antenna elements 20, 22 are disposed in conducting element 14. Each notch 20, 22 has a broad end 20*a*, 22*a* disposed on the leading edge of the substrate forming ground plane(s) 60. Each tapered notch element 20, 22 is disposed transverse to the respective feed strip 16,18 and is electromagnetically coupled thereto. The antenna elements 20, 22 are spaced apart a given distance X to enable grating lobe free operation at an upper frequency band.

Figure 2:
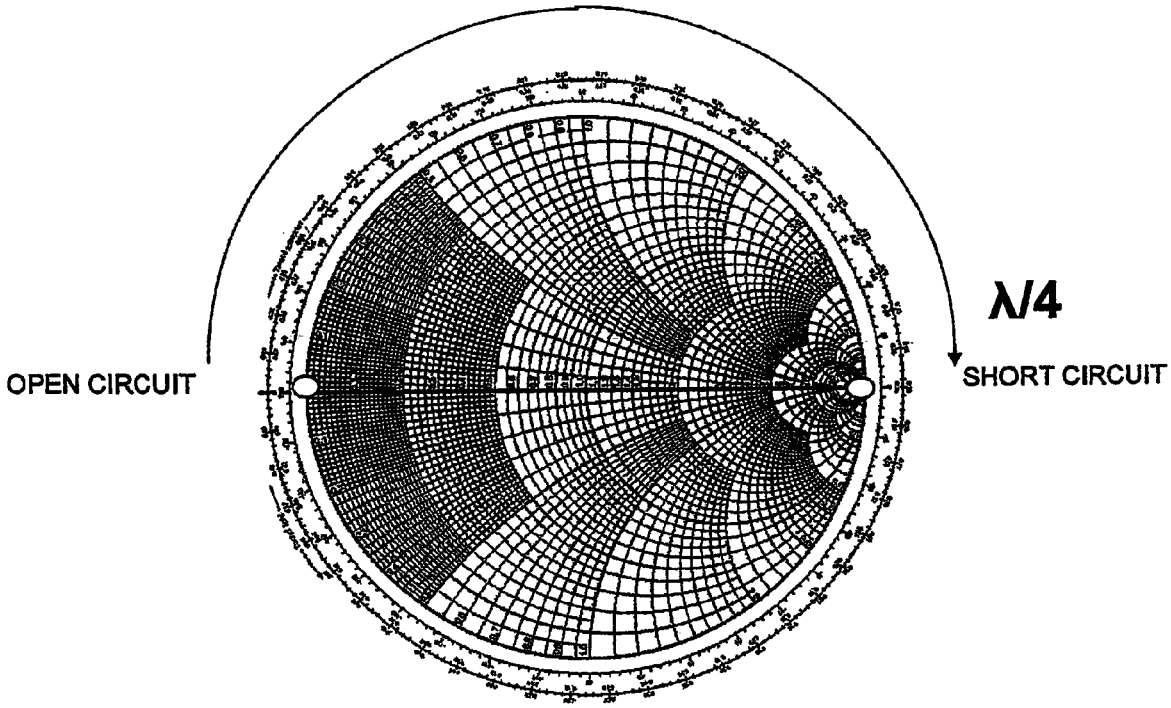
FIG. 2 is a schematic illustration of a Smith Chart Impedance Plot useful in describing the principles of the present invention.

Transmission line 16 has a first arm segment 16*a* in a plane parallel to slot 23 and a second arm segment 16*b* normal to first arm segment 16*a* and terminating at an end that is electromagnetically one quarter wavelength from slot 23 and is open circuited at end point B. As is understood from transmission line theory and as illustrated in FIG. 2, an open circuit appears as a short circuit when viewed at a distance of one quarter of an operating wavelength. Therefore, the terminating end at one quarter wavelength from slot 23 therefore reflects a short circuit between the radiating element and the transmission line conductor at point B and thus operates to transfer energy to the ground plane and excite antenna element 20 at the lower frequency band. With regard to notched element 22, the distance d associated with notch antenna 22 of one quarter wavelength that is short circuited presents an open circuit at element feed point C, thereby exciting the element in a balanced mode of operation. Reference numeral 30 depicts an element matching transformer in this segment of feed line 18. The aforementioned structure can have impedance matching at either the higher or lower frequency band (e.g. S-Band or C-Band); however, such structure may not be capable of performing impedance matching at both frequency bands.

It is noted that transmission line theory as depicted in the Smith Chart of FIG. 2 wherein an impedance presented by a load along a transmission line is modulo Pi repeating every one half wavelength such that an open circuit at one quarter wavelength appears as a short circuit, is applied by the present invention to enable a dual band antenna structure with radiating elements whose impedance can be matched over multiple frequency bands and passively switch operation between those bands.

Figure 3:
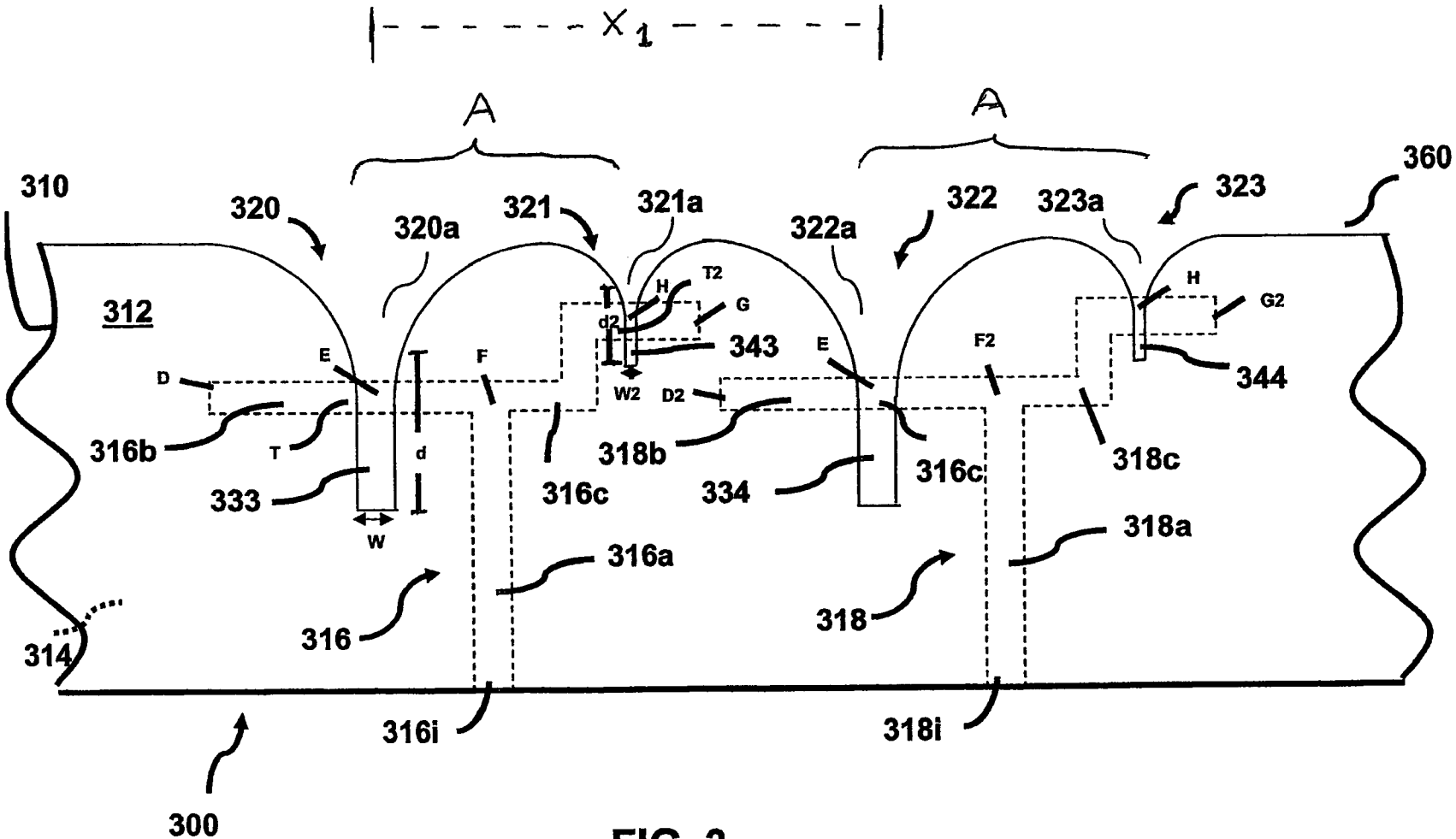
FIG. 3 is an exemplary illustration of two sets of element pairs in a linear antenna array configured for dual band operation according to an embodiment of the present invention.

Referring now to FIG. 3, there is shown a portion of a dual band antenna array structure 300 according to an embodiment of the present invention. Two sets of element pairs in a linear array of antenna elements are shown with the transmission line ground plane and radiating element structure provided in solid lines and the element feed structures provided in dashed lines for a stripline or microstrip implementation. By way of example only, a linear array of notch antenna elements is configured for excitation (e.g. resonance) at a first frequency band (e.g. a lower band) and are spaced apart in the E-Plane to provide grating lobe-free radiation at a second frequency band (e.g. an upper band). Interspersed between these elements is a second set of notch elements (e.g. smaller notch elements) configured for resonance at the second (upper) band. A single feed line or transmission line 316 feeds a reactive power divider F that, in turn, feeds a pair (320, 321) of the notched elements; one for the lower frequency band F1 and one for the upper frequency band F2. In an exemplary embodiment, the notch antenna elements may be configured as Vivaldi notch antennas, and may further be configured as exponential tapered or flared notch antenna elements.

In the exemplary embodiment depicted in FIG. 3, the shape of the tapered notches depends on the desired bandwidth, size of the antenna, and matching impedance, for example. Impedance matching may be accomplished by placing conductive transmission line segments in appropriate locations with respect to the tapered notch elements, thereby affecting the electrical coupling between the transmission line and the antenna elements.

The antenna array 300 of FIG. 3 may be formed on a coplanar substrate 310, which may, in an exemplary embodiment, be made of two sheets of dielectric material pre-clad with metallic copper or other electrically conducting sheets 312, 314. The structure may be fabricated from two individual sheets with one being pre-clad on both sides and the other clad on one side with sheets 312, 314 from which portions of the sheet have been cut away to leave radiating elements and striplines or transmission lines 316, 318. By cutting away the electrically conducting sheets on each of the dielectric in mirror image fashion to form the radiating elements, and with the center conductor formed on the dielectric sheet, the two sheets may be laminated together so that the total laminated antenna structure includes the transmission lines and dipole structures which are portions of the electrically conducting sheets 312, 314 comprising the exterior or "skin" of the antenna array structure. U.S. Pat. No. 3,845,490 issued Oct. 29, 1974 to Mannwarren entitled "Stripline Slotted Balun Dipole Antenna" discloses such fabrication and feed arrangement for implementation with the present invention, the subject matter thereof being incorporated herein by reference in its entirety. It is understood that while the above subject matter has been described with respect to a stripline implementation, the present invention may be embodied in other forms, including but not limited to the form of a microstrip using a single sheet with the feed line etched on one side and the radiating element etched from the ground plane on the other side.

Still referring to FIG. 3, conductive layer 312 encompasses a linear array of flared or tapered notch antenna element pairs 320 and 321, 322 and 323, etc. each having broad ends 320*a*, 321*a*, 322*a*, 323*a* disposed on the same leading edge of the substrate or stripline ground plane, and tapering down to slot lines 323, 343, 324, 344. The configuration of the tapered notch regions is a parallel, linear arrangement along the leading edge 360 of the ground plane. By way of example and not limitation, the particular broadband antenna specifications for antenna array 300 may be designed to transmit and/or receive signals in a first frequency band F1 of about 3 Giga Hertz (GHz), and in a second frequency band F2 of about 5 GHz. The antenna array length, element slot width, and taper are driven by requirements specific to the application of the array, including beamwidth, scan volume, operational bandwidth, and the like. In general, the spacing between the elements for the lower frequency band will vary from slightly less than about one wavelength at the upper frequency for no scan in the plane of the linear array, varying down to about one half wavelength for scans of up to 90 degrees.

In one configuration, identical elements 320, 322 are spaced apart or separated from one another a predetermined distance X1 to enable grating lobe free operation of the antenna array at a given frequency band. In the exemplary embodiment illustrated in FIG. 3, the notch antenna elements 320, 322 are configured for excitation at a first lower frequency band F1. The notch antenna elements 320, 322 have substantially identical dimensions, including notch length d, taper, and slot width w.

Disposed between each of the low frequency band notch antenna elements 320, 322 is a corresponding smaller notched antenna element 321, 323, etc. configured for operating at a relatively higher frequency band. Like elements 320, 322, notch elements 321, 323 also have broad ends 321*a*, 323*a* disposed on the same leading edge of the substrate or stripline or microstrip ground plane, and tapering down to slot lines 343, 344. The configuration of the tapered notch regions is a parallel, linear arrangement along the leading edge of the ground plane.

The smaller tapered notch antenna elements extend from the leading edge a distance d2, which is less than the distance d of tapered notch antenna elements 320, 322. The smaller tapered notch antenna elements also have a smaller slot width w2. Like the lower band antenna elements, the higher band elements 321, 323 are configured to be substantially identical to one another, but have a different configuration or dimension (e.g. including notch length, taper, and slot width w associated with their frequency of operation) from that associated with the lower band elements 320, 322.

A single transmission line or feed line 316 feeds a reactive power divider F that, in turn, feeds a pair (e.g. 320, 321) of the notched elements; one for the lower band and one for the upper band. In the exemplary embodiment shown in FIG. 3, transmission line 316 having input feed terminal 316*i* comprises a first common arm or line segment 316*a* in a plane parallel to slots 323, 343, and a second arm segment 316*b* normal to first arm segment 316*a* and terminating at an end that is electromagnetically one quarter wavelength at the center of the lower operating frequency band from slot 323 and is open circuited at end D. It is understood that second arm segment 316*b* need not be normal to, but simply connected in a manner that is impedance matched to first arm segment 316*a*. A third arm segment 316*c* comprises a step-like arrangement (by way of example only) extending first in a direction normal to first segment 316*a*, then in a direction parallel thereto, and finally terminating at an end normal to segment 316*a* that is one quarter wavelength at the center of the upper operating frequency band from slot 343 and is open circuited at end G. The width of the segments of transmission lines 316 and 318 are determined by the dielectric constant and thickness of the substrate material, and the transmission line impedances for matching the impedances of the radiating element feed points of 320 and 321 to the input of the structure at 316*i*. The notch antenna structure and transmission line configuration described above and as illustrated in FIG. 3 repeats itself in the E-plane for antenna element pairs 320, 321, and elements 322, 323, which elements are fed by corresponding transmission line 318 and may repeat in the H-Plane to populate a phased array. Transmission line 318 is configured identically to transmission line 316 for feeding antenna element pair 322, 323 and includes input feed terminal 318*i* for receiving or transmitting signals of a frequency within one of the frequency bands associated with elements 323, 323. A first common arm or line segment 318*a* branches at power divider F into a second arm segment 318*b* terminating at an end that is electromagnetically one quarter wavelength at the center of the lower operating frequency band from slot 324 and is open circuited at end D2. Third arm segment 318*c* terminates at an end normal to segment 318*a* that is one quarter wavelength at the center of the upper operating frequency band from slot 344 and is open circuited at end G2.

The total number of antenna array elements may vary according to the particular application but include at least one pair (e.g. 320, 321) of integrated antenna elements (e.g. notch antenna elements) within a single aperture A and configured to be responsive to different excitation frequencies. A single transmission line includes a power divider for branching line segments transversely to each of the antenna elements.

From the power divider F, the transmission feed lines are constrained by the requirement that the open circuited end D feeding the lower band notch antenna element 320 be an integral number of half wavelengths away from the power divider at position F at the upper frequency band to present an open circuit at the higher frequency band for preventing energy from entering leg 316*c* of the feed line at the upper band.

Further, the open circuited end G of the transmission line feeding the upper band notch antenna element 321 is an integral number of half wavelengths apart from the power divider F at the lower frequency band to present an open circuit at the lower band for preventing energy from entering leg 316*b* of the feed line at the lower band.

At each of the two slot positions E and H associated with notch elements 320, 321, respectively, sufficient transmission lengths are provided between the element notch slot and the power divider F to accommodate an impedance matching transformer T. A conventional impedance matching transformer T such as a stepped impedance transmission line transformer, may be coupled at slot position E and configured at the low band to provide an impedance match between E and F at the low frequency band. Similarly, an impedance matching transformer T2 may be coupled at slot position H and configured at the high band to provide an impedance match between H and F at the high frequency band. Impedance matching transformers T and T2 are designed such that, when combined at the power divider F, an input impedance is presented with respect to the input 316*i* to allow maximum power transfer to the appropriate radiating element at each of the operating frequency bands.

The operating frequency bands should be sufficiently separated in frequency to maintain the quality of the open circuits to ensure passive switching of the antenna array between the upper and lower frequency bands. In a preferred embodiment, the frequency band difference is on the order of one or more octaves.

In operation, the dual mode antenna functions such that when a lower band signal F1 is carried by transmission line 316 (via input 316*i*), the open circuit at position D at one quarter wavelength away from feed point position E of antenna element 320 appears as a short circuit at the feed point position D. This causes the transmission line to thereby energize the antenna element 320. At the lower frequency band, the open circuit position G is an even number of quarter wavelengths (i.e. an integer number of half wavelengths) away from power divider position F so that it appears as an open circuit at F at the lower band. In this case, segment 316*c* is reflective and no signal (no energy) is propagated in this line segment 316*c* at the lower frequency band.

For operation at the higher frequency band, the dual mode antenna functions such that transmission line 316 carries the upper band frequency signal F2 via input line 316*i*. The open circuit at position G at one quarter wavelength away from feed point position H of antenna element 321 appears as a short circuit at the feed point position G. This causes the transmission line to thereby energize the antenna element 321. At the higher frequency band, the open circuit position D is an even number of quarter wavelengths (i.e. an integer number of half wavelengths) away from power divider position F so that it appears as an open circuit at F at the higher band. In this case, segment 316*b* is reflective and no signal (no energy) is propagated in this line segment 316*b* at the higher frequency band.

In this manner, the configuration performs a self-switching based on the input frequency to automatically excite either the lower band or the upper band antenna elements according to the frequency at the input feed. Thus, the present invention may operate to minimize insertion losses, eliminate active circuitry, and automatically switch operating bands without requiring intervention.

According to an aspect of the present invention, the common leg segment 316*a* of the power divider may feed an active Transmit/Receive (T/R) module, or may be combined into subarrays using a transmission line feed network, such as a corporate feed, series, tandem-series, Blass network, and the like. Furthermore, the spacing between the leading edge of the notch elements and the ground plane behind the elements should be set to provide acceptable broadside element pattern performance for each element at its active frequency band.

The present invention may be embodied in a dual mode antenna array consisting of many thousands of antenna elements configured as described herein and arranged in stacks of substrates or sub-array lattice structures, as may be understood by one of ordinary skill in the art. The antenna array may be configured as a phased array antenna for dual band operation wherein the bands are separated by about at least one octave. Such phased array antennas are believed suitable for phased array radar systems, satellite communications arrays, and data communications systems (such as cellular telephony), for example. Implementation of separate but integral antenna elements for each different band within a same aperture along with separate matching transformers for each element, in combination with a feed method that passively and automatically selects the proper element for excitation associated with the band of interest, eliminates the need for electronic or electromechanical switches for switching between modes, while reducing circuit complexity and control requirements.

While the present invention has been described with reference to the illustrative embodiments, this description is not intended to be construed in a limiting sense. Various modifications of the illustrative embodiments, as well as other embodiments of the invention, will be apparent to those skilled in the art on reference to this description.

For example, the invention may be implemented in other forms or combinations of transmission lines such as coaxial lines or coplanar waveguides. Furthermore, while flared notch antenna or Vivaldi antenna elements have been described herein as exemplary antenna elements, it is understood that the invention may be applicable to other antenna element types, including for example, slot-fed or aperture-fed patch antenna elements. Still further, the co-planar substrate structure and fabrication method, transmission line and feed method disclosed herein represent non-limiting examples of application of the present invention. For example, the substrate may be formed of a material such as FR-4 or RT-Duroid and fabricated from a material such as PFTE or fiberglass; low density foam and air dielectric stripline or microstrip are also applicable. The conductive layer formed on the substrate may comprise a copper, silver, or other conductive alloy or conductive material and may be applied by etching a plated substrate or by electroplating, for example.

It is therefore contemplated that the appended claims will cover any such modifications or embodiments as fall within the true scope of the invention.

What is claimed is:

1. A dual band antenna array comprising:

a pair of coplanar antenna elements, a first antenna element of said pair excitable at a frequency within a first frequency band, a second antenna element of said pair excitable at a frequency within a second frequency band; and a single transmission feed line in a second plane having an input for receiving a signal, the feed line dividing at a branch point into a first line segment for communicatively coupling the first antenna element with the input at a first feed point, and a second line segment for communicatively coupling the second antenna element with the input at a second feed point, wherein the first and second line segments have lengths adapted for impedance matching at the first and second frequency bands, respectively, relative to the feed line input, to selectively allow energy transmission in one of the first and second line segments while reflecting energy in the other line segment according to the input signal frequency, whereby the antenna elements are passively switched based on the input signal frequency.

2. The dual band antenna array of claim 1, wherein the first line segment includes an end that terminates in an open circuit a distance from the first feed point of about one quarter wavelength at the first frequency band, and wherein the second line segment includes an end that terminates in an open circuit a distance from the second feed point of about one quarter wavelength at the second frequency band.

3. The dual band antenna array of claim 2, wherein the terminating end of the first line segment is spaced a distance of about an integer number of half wavelengths from the branch point of the transmission line at the first frequency band, and wherein the second line segment is spaced a distance of about an integer number of half wavelengths from the branch point of the transmission at the second frequency band.

4. The dual band antenna array of claim 1, wherein the first and second antenna elements are notch antenna elements of different slot size formed within a single aperture.

5. The dual band antenna array of claim 4, wherein the first and second antenna elements are tapered notch antenna elements.

6. The dual band antenna array of claim 1, wherein the array is passively switched between operation at the first frequency band and the second frequency band according to the signal frequency received or transmitted at the input of the transmission feed line.

7. The dual band antenna array of claim 1, further comprising a matched circuit formed in each of said first and second line segments for impedance matching with respective ones of the first and second antenna elements.

8. The dual band antenna array of claim 7, wherein each matched circuit comprises an impedance transformer element.

9. The dual band antenna array of claim 1, wherein the first and second frequency bands are separated by one or more octaves.

10. The dual band antenna array of claim 1, wherein the transmission feed line comprises one of a microstrip and stripline transmission line.

11. The dual band antenna array of claim 1, wherein the first and second antenna elements are disposed on a first surface of a substrate, and wherein the feed line is disposed on a second surface of said substrate.

12. The dual band antenna array of claim 1, further comprising one of a transmit/receive module and a passive divider network, coupled to said input of said single transmission feed line.

13. The dual band antenna array of claim 12, wherein said passive divider network comprises at least one of a series network, corporate network, and Blass network.

14. The dual band antenna array of claim 1, further comprising a plurality of said first and second antenna elements formed on a conductive layer and configured in an interleaved arrangement to form a linear array of said antenna elements, a substrate having a first surface carrying said first and second antenna elements, and a plurality of said single transmission feed lines carried on a second surface of the substrate, said single transmission feed lines feeding corresponding pairs of said first and second antenna elements.

15. The dual band antenna array of claim 14, wherein each of said plurality of antenna elements is spaced a distance from one another sufficient for grating lobe free operation.

16. The dual band antenna array of claim 15, wherein each of said plurality of antenna elements comprises notch antenna elements.

17. A dual band antenna array comprising:

a substrate;

a pair of linearly arranged antenna elements on a side of the substrate and configured within a given aperture for excitation at corresponding separate frequency bands separated by one or more octaves;

a single transmission feed line having an input for receiving an input signal, the feed line disposed on another side of the substrate and having first and second branched portions adapted for electromagnetically coupling to respective ones the pair of the antenna elements without contacting said antenna elements; wherein the respective lengths of the first and second branch portions are adapted for impedance matching at the first and second frequency bands, respectively, relative to the feed line input, for directing the input signal only through the first branch portion when the input signal is in the first frequency band, and for directing the input signal only through the second branch portion when the input signal is in the second frequency band, whereby the antenna elements are passively switched according to the input signal frequency.

18. The dual band antenna array of claim 17, further comprising an impedance transformer disposed within the first branch portion for impedance matching the single transmission feed line at the first frequency band.

19. The dual band antenna array of claim 17, further comprising a second impedance transformer disposed within the second branch portion for impedance matching the single transmission feed line at the second frequency band.

20. The dual band antenna array of claim 17, wherein the pair of linearly arranged antenna elements comprises one of: a pair of notch antenna elements; and, a pair of patch antenna elements.

21. The dual band antenna array of claim 17, wherein the first branch traverses the first antenna element at a feed point and terminates at an end that is open-circuited, the end spaced apart from the feed point of the first antenna element a distance of one quarter wavelength at the first frequency band.

22. The dual band antenna array of claim 21, wherein the second branch traverses the second antenna element at another feed point and terminates at an end that is open-circuited, the end spaced apart from the another feed point of the second antenna element a distance of one quarter wavelength at the second frequency band.

23. A dual band antenna system comprising:

a substrate having a first side and a second side;

a conductive layer disposed on said first side and configured to form a linear array of interleaved pairs of first and second antenna elements, said first antenna elements excitable at a first frequency band, said second antenna elements excitable at a second frequency band, each pair having an associated single transmission feed line disposed on the second side of the substrate for carrying an input signal at a frequency causing excitation of one of said element pairs, each single transmission feed line dividing at a branch position into a first line segment and a second line segment, the first line segment electromagnetically coupled to said corresponding first antenna element of said pair at a first feed point, and the second line segment electromagnetically coupled to said corresponding second antenna element of said pair at a second feed point, wherein an end of the first line segment terminates in an open circuit a distance of about one quarter wavelength from the first feed point at the first frequency band, and an end of the second line segment terminates in an open circuit a distance of about one quarter wavelength from the second feed point at the second frequency band, and wherein the terminating ends of the first and second line segments are an integer number of half wavelengths from the branch position at the first and second frequency bands, respectively.

24. The dual band antenna array of claim 23, wherein each pair of antenna elements comprises first and second notch antenna elements formed within a given aperture.

25. The dual band antenna array of claim 24, wherein the first notch antenna elements are sized larger than and are excitable at a lower frequency band than the second notch antenna elements.

26. The dual band antenna array of claim 23, wherein the pairs of antenna elements repeat in the E-plane.

27. The dual band antenna array of claim 23, wherein the pairs of antenna elements repeat in the H-plane.

28. The dual band antenna array of claim 23, wherein each transmission line further includes a separate impedance transformer formed between the branch point and the respective feedpoints for impedance matching the transmission line at each of the frequency bands.

29. A dual band antenna array comprising:

a conductive layer disposed on a first surface of a substrate forming a first set of tapered notch antenna elements configured for excitation at a lower frequency band and a second set of smaller tapered notch antenna elements configured for excitation at an upper frequency band, the first and second sets of notch antenna elements being interleaved to provide a linear array defining pairs of first and second notch antenna elements;

each said pair of first and second notch antenna elements associated with a respective transmission feed line formed on a second surface of the substrate, said transmission fee line feeding a reactive power divider that, in turn, feeds said pair of the antenna elements via a first transmission segment having a portion traversing the first notch antenna element, and a second transmission segment having a portion traversing the second notch antenna element; the first segment terminating in an open circuit feeding the first notch antenna element and spaced an integral number of half wavelengths from the power divider at the upper frequency band to prevent energy from entering the first segment of the transmission feed line at the upper frequency band; the second segment terminating in an open circuit feeding the second notch antenna element and spaced an integral number of half wavelengths from the power divider at the lower frequency band to prevent energy from entering the second segment of the transmission feed line at the lower frequency band.

30. The dual band antenna array of claim 29, further comprising an impedance matching transformer positioned between the power divider and the first tapered notch antenna element slot for providing transmission line impedance matching at the corresponding frequency band associated with the first tapered notch antenna element.

31. The dual band antenna array of claim 30, further comprising an impedance matching transformer positioned between the power divider and the second tapered notch antenna element slot for providing transmission line impedance matching at the corresponding frequency band associated.

32. A method for operating a dual band antenna array comprising: providing a pair of coplanar antenna elements excitable at separate frequency bands;

feeding said pair of coplanar antenna elements via a single transmission feed line formed in a second plane and having an input for receiving a signal, the feed line dividing at a branch point into a first line segment extending transversely over a first one of said pair of antenna elements at a first feed point, and a second line segment extending transversely over a second one of said pair of antenna elements at a second feed point, the lengths of the first and second transmission line segments adapted according to the first and second frequency bands relative to the feed line input for matching the impedance of the antenna frequency bands with the transmission line impedance to allow efficient transfer of energy to and from the antenna elements, and selectively applying a signal frequency within one of the separate frequency bands to selectively allow energy transmission in one of the first and second line segments while reflecting energy in the other line segment for communicatively coupling the transmission line input with the corresponding antenna element via the corresponding feed point, whereby the activated antenna elements are passively switched based on the applied signal frequency.

33. The method of claim 32, further comprising providing a substrate and disposing a conductive layer on a first surface of the substrate to form said antenna elements.

34. The method of claim 33, further comprising disposing said transmission line on a second surface of said substrate.

35. The method of claim 32, further comprising providing an impedance matching transformer within each of the first and second line segments.

36. The method of claim 32, further wherein the separate frequency bands are separated by one or more octaves.

37. A dual band antenna system comprising:

a substrate having a first side and a second side;

a conductive layer disposed on said first side and configured to form a linear array of interleaved pairs of first and second antenna elements, said first antenna elements excitable at a first frequency band, said second antenna elements excitable at a second frequency band, each pair having an associated single transmission feed line disposed on the second side of the substrate for carrying an input signal at a frequency causing excitation of one of said element pairs, each single transmission feed line dividing at a branch position into a first line segment and a second line segment, the first line segment electromagnetically coupled to said corresponding first antenna element of said pair at a first feed point, and the second line segment electromagnetically coupled to said corresponding second antenna element of said pair at a second feed point, wherein an end of the first line segment terminates in an open circuit a distance of about one quarter wavelength from the first feed point at the first frequency band, and an end of the second line segment terminates in an open circuit a distance of about one quarter wavelength from the second feed point at the second frequency band, and wherein the terminating ends of the first and second line segments are an integer number of half wavelengths from the branch position at the first and second frequency bands, respectively, wherein each pair of antenna elements comprises first and second notch antenna elements formed within a given aperture, and wherein the first notch antenna elements are sized larger than and are excitable at a lower frequency band than the second notch antenna elements.

38. A dual band antenna system comprising:

a substrate having a first side and a second side;

a conductive layer disposed on said first side and configured to form a linear array of interleaved pairs of first and second antenna elements, said first antenna elements excitable at a first frequency band, said second antenna elements excitable at a second frequency band, each pair having an associated single transmission feed line disposed on the second side of the substrate for carrying an input signal at a frequency causing excitation of one of said element pairs, each single transmission feed line dividing at a branch position into a first line segment and a second line segment, the first line segment electromagnetically coupled to said corresponding first antenna element of said pair at a first feed point, and the second line segment electromagnetically coupled to said corresponding second antenna element of said pair at a second feed point, wherein an end of the first line segment terminates in an open circuit a distance of about one quarter wavelength from the first feed point at the first frequency band, and an end of the second line segment terminates in an open circuit a distance of about one quarter wavelength from the second feed point at the second frequency band, and wherein the terminating ends of the first and second line segments are an integer number of half wavelengths from the branch position at the first and second frequency bands, respectively, wherein the pairs of antenna elements repeat in at least one of a) the E-plane, and b) the H-plane.

39. A dual band antenna system comprising:

a substrate having a first side and a second side;

a conductive layer disposed on said first side and configured to form a linear array of interleaved pairs of first and second antenna elements, said first antenna elements excitable at a first frequency band, said second antenna elements excitable at a second frequency band, each pair having an associated single transmission feed line disposed on the second side of the substrate for carrying an input signal at a frequency causing excitation of one of said element pairs, each single transmission feed line dividing at a branch position into a first line segment and a second line segment, the first line segment electromagnetically coupled to said corresponding first antenna element of said pair at a first feed point, and the second line segment electromagnetically coupled to said corresponding second antenna element of said pair at a second feed point, wherein an end of the first line segment terminates in an open circuit a distance of about one quarter wavelength from the first feed point at the first frequency band, and an end of the second line segment terminates in an open circuit a distance of about one quarter wavelength from the second feed point at the second frequency band, and wherein the terminating ends of the first and second line segments are an integer number of half wavelengths from the branch position at the first and second frequency bands, respectively, wherein each transmission line further includes a separate impedance transformer formed between the branch point and the respective feedpoints for impedance matching the transmission line at each of the frequency bands.

* * * * *